United States Patent [19]

Voss

[11] 3,949,677

[45] Apr. 13, 1976

[54] SMALL CALIBER PROJECTILE WITH AN ASYMMETRICAL POINT

[75] Inventor: Gunther Voss, Madrid, Spain

[73] Assignee: Centro de Estudios Tecnicos de Materiales Especiales-Instituto Nacional de Industria, Madrid, Spain

[22] Filed: Mar. 19, 1974

[21] Appl. No.: 452,556

[30] Foreign Application Priority Data

Jan. 19, 1974 Spain ..... 199626

[52] U.S. Cl. ..... 102/92.1; 244/3.1

[51] Int. Cl.[2] ..... F42B 11/00

[58] Field of Search ..... 102/92.1–92.4; 244/3.1, 3.23

[56] References Cited

UNITED STATES PATENTS

| | | | |
|---|---|---|---|
| 671,877 | 4/1901 | Cole | 244/3.23 |
| 1,178,516 | 4/1916 | Hardcastle | 102/92.1 |
| 2,612,108 | 9/1952 | Schmidt | 102/92.2 |
| 3,357,357 | 12/1967 | Voss | 102/92.3 |
| 3,401,637 | 9/1968 | Briscoe | 102/92.1 |

*Primary Examiner*—Charles T. Jordan

*Attorney, Agent, or Firm*—Woodcock, Washburn, Kurtz & Mackiewicz

[57] ABSTRACT

A projectile of the type to be stabilized by rotation is formed with an asymmetrical point. In one embodiment a pair of unequal, diametrically opposed recesses are provided and apportioned so that the center of gravity of the projectile is located along the projectile's axis of rotation.

5 Claims, 4 Drawing Figures

SMALL CALIBER PROJECTILE WITH AN ASYMMETRICAL POINT

Figure 1:
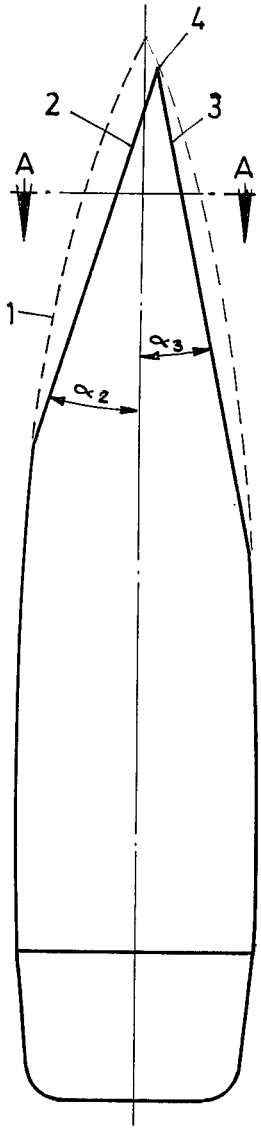

The present invention relates to a small-caliber projectile, stabilized by rotation, which is primarily designed for infantry weapons, and which has an asymetrical point (nose) which exerts its effect upon the penetration of the projectile in the target.

In infantry projectiles having an asymmetry tending to increase their effects known up to now, this asymmetry consists of the bevelling (chamfering) of the tip of the projectile. The dimensions of this bevel have to be relatively small, since the deviations from the center of gravity and from the main inertia axis of the projectile produced thereby, and with this the increases in the ballistic dispersion which result from these deviations, should be kept within permissible limits. As a consequence of this, the forces that act upon this bevel when the projectile penetrates into the human body are also relatively small and therefore contribute very little to the acceleration of the spinning of the bullet produced during this penetration as well as to the increased effects resulting from this acceleration. In addition, in these known projectiles, the reduction of caliber permitted by an asymmetry of the point of the bullet, without decreasing its stopping power, is very small.

The object of the present invention is to make possible a small-caliber projectile which does not have these disadvantages and whose caliber, consequently, can be reduced even more than that of the asymmetrical projectiles heretofore known, without allowing this reduction in caliber to diminish either its stopping power or its accuracy.

This problem is solved, in accordance with the present invention, by giving the projectile certain contours in which the asymmetry of its point is not formed, as it has been until now, by a single bevel, but by two unequal, diametrically opposite recesses. It becomes feasible, with this projectile shape, even when the two recesses are very unequal, to maintain the deviation from the main inertia axis of the projectile, caused by this asymmetry, within narrow limits, and completely avoid a displacement of its center of gravity in relation to its axis of rotation. The two recesses made in the tip can, therefore, in this projectile, unlike the projectiles provided with a single bevel known up to now, be extensively enlarged and the efficiency of the projectile can be increased accordingly, without being obtained at the cost of a loss in accuracy.

Furthermore an enlargement of the two recesses made in the projectile's point, results in a reduction of the angles formed thereby with the axis of the projectile, and in this way, further originates a reduction in air drag and an improvement in the ballistics of the projectile. While in projectiles having a single bevel known up to now this angle should not be less than 30°, so as the displacement of the center of gravity produced by the bevel should remain within permissible limits, in accordance with the present invention, in projectiles whose point has two diametrically opposite recesses, the angles formed by these recesses with the projectile's axis can be much smaller than 30°, without causing a lateral displacement of the center of gravity of the projectile.

These recesses can be constituted by flat or curved surfaces, the latter being either convex or concave. Convex recesses afford, compared to flat recesses, above all, the advantage of providing the bullet with improved ballistic qualities, whereas concave recesses afford an increased effect at the target.

Details of the invention can be seen in the embodiments represented in the enclosed drawings, which show:

FIG. 1. A view of a small-caliber projectile according to the present invention.

Figure 2:
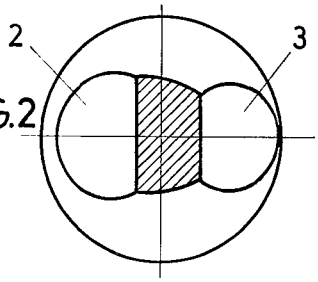

FIG. 2. A cross section of the projectile according to FIG. 1 along the line A—A.

Figure 3:
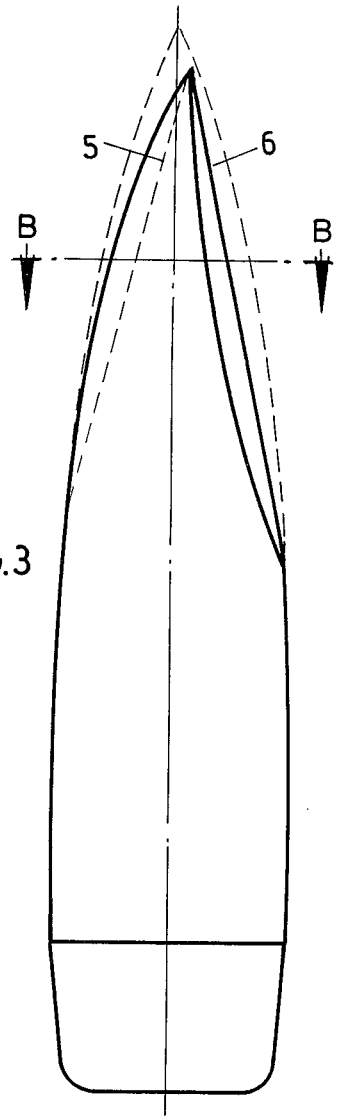

FIG. 3. A view of another projectile in accordance with the invention.

Figure 4:
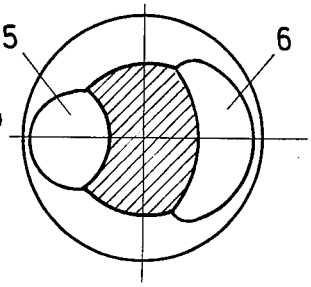

FIG. 4. A cross section of the projectile according to FIG. 3 along the line B—B.

In the projectile illustrated in FIGS. 1 and 2, the recesses 2 and 3, milled in the ogive 1, are flat surfaces, the ogive being, as in the entire projectile, before this milling operation, a body of revolution whose outline is drawn in FIG. 1 in broken lines.

Angles $\alpha_2$ and $\alpha_3$, which form these planes with the axis of the projectile, are, as shown in FIG. 1, much smaller than 30° and originate, for this reason, little air drag.

According to the size of these two recesses which extends over almost the entire length of the ogive of the projectile, as well as to the inequality of angles $\alpha_2$ and $\alpha_3$ formed by them with the axis of the projectile, the forces, which act on the surface of the projectile during impact with the target, produce, in relation to the center of gravity of the projectile, a strong rotational torque which is perpendicular to its plane of symmetry and which gives rise to a rapid spinning of the projectile.

The point 4 of the projectile, formed by these two recesses, is not located, as shown in FIG. 1, on the axis of rotation of the projectile, but is displaced towards one side of said projectile. The magnitude of this displacement has been determined in such a way that, using a homogeneous material for the projectile, its center of gravity does not undergo, on account of the milling of the two recesses and in spite of the asymmetry produced by the inequality of angles $\alpha_2$ and $\alpha_3$, any lateral displacement, which means that the center of gravity of the projectile after the milling of the two recesses remains the same as before, on the rotational axis thereof.

FIGS. 3 and 4 show, as another example of an embodiment of the invention, a projectile in which the two recesses 5 and 6 are formed by curved surfaces. These are also located in such a way that the center of gravity of the projectile undergoes no lateral displacement upon milling. Recess 5 is, for this projectile, a concave, cylindrical surface; recess 6 is a convex, cylindrical surface. The axes of both cylinders are located in one plane which is, at the same time the plane of symmetry of the projectile. The rotary torque generated by the forces that act, at the moment of impact, upon the surface of the projectile is, in this projectile and in relation to this center of gravity, much greater; and its effect, also, is therefore noticeably more pronounced, than in the projectile shown in FIGS. 1 and 2.

What is claimed is:

1. A small-caliber projectile with an asymmetrical tip, of the type stabilized by rotation, and whose tip is provided with an asymmetry which exerts its effects upon penetration of the projectile in a target, characterized that in the tip of the projectile there are two diametrically located recesses which are unequal with respect to each other, said recesses having the effect of increasing the rate of spin of the projectile during its penetration into a target.

2. A small-caliber projectile with an asymmetrical tip as set forth in claim 1, characterized in that the angles formed by the two recesses with the axis of the projectile are distinct with respect to each other, and in addition are advantageously less than 30°, in order to originate little air drag.

3. A small-caliber projectile with an asymmetrical tip as set forth in claim 2, characterized in that the tip of the projectile is formed by the two recesses, and is eccentric with relation to the axis thereof, due to the differences existing between said recesses; this eccentricity being related to said diametrical recesses in such a way that the projectile's center of gravity is located on the rotational axis thereof.

4. A small-caliber projectile with an asymmetrical tip as set forth in claim 3 characterized in that the tip is formed in the manner of an ogive and said recesses are disposed in the ogive and are formed by flat surfaces, according to the rotational torque required.

5. A small-caliber projectile with an asymmetrical tip as set forth in claim 3 characterized in that the tip is formed in the manner of an ogive and said recesses are disposed in the ogive and are formed by curved surfaces, according to the rotational torque required.

* * * * *